United States Patent [19]

Wakita et al.

[11] 4,177,641

[45] Dec. 11, 1979

[54] APPARATUS FOR CLEANING EXHAUST GAS FOR AN INTERNAL COMBUSTION ENGINE

[75] Inventors: Nobuaki Wakita; Eiji Hashimoto, both of Susono, Japan

[73] Assignee: Toyota Jidosha Kogyo Kabushiki Kaisha, Toyota, Japan

[21] Appl. No.: 910,097

[22] Filed: May 30, 1978

[30] Foreign Application Priority Data

Mar. 7, 1978 [JP] Japan ..... 53/024990

[51] Int. Cl.[2] ..... F02B 75/10; F01N 3/10

[52] U.S. Cl. ..... 60/278

[58] Field of Search ..... 60/278

[56] References Cited

U.S. PATENT DOCUMENTS

| | | | |
|---|---|---|---|
| 3,765,210 | 9/1973 | Kuehl | 72/164 |
| 3,799,131 | 3/1974 | Bolton | 123/119 A |
| 3,802,402 | 4/1974 | Swatman | 123/119 A |
| 3,983,697 | 10/1976 | Goto | 60/278 |
| 4,088,101 | 5/1978 | Wakita | 123/119 A |

*Primary Examiner*—Douglas Hart

*Attorney, Agent, or Firm*—Kenyon & Kenyon

[57] ABSTRACT

Disclosed herein is an apparatus for cleaning the exhaust gas of an internal combustion engine, which apparatus includes an exhaust gas recirculation system provided with a back-pressure control mechanism for maintaining a predetermined constant pressure of recirculated exhaust gas in a recirculation passageway, and an air injection system connecting an air pump with an exhaust system of the engine. An air-flow control valve having two vacuum chambers arranged between the air injection system and the exhaust gas recirculation system for controlling, in two stages, the amount of air diverted from the air injection system to the recirculation passageway. One of the chambers is directly connected to a vacuum source in the intake system of the engine. While the other is connected, via a vacuum delay unit, to the vacuum source.

2 Claims, 2 Drawing Figures

APPARATUS FOR CLEANING EXHAUST GAS FOR AN INTERNAL COMBUSTION ENGINE

FIELD OF THE INVENTION

The present invention relates to an apparatus for cleaning the exhaust gas of an internal combustion engine, provided with an exhaust gas recirculation system of a back-pressure control type and with a secondary air introduction system, which apparatus can effectively control the amount of recirculated exhaust gas and the air-fuel ratio of a combustible mixture introduced into the engine.

An exhaust gas recirculation system of a back-pressure control type can maintain, in every kind of operating condition of the engine, a predetermined constant ratio of the amount of recirculated exhaust gas to the amount of total gas introduced into the engine (so-called EGR ratio), since the pressure of the recirculated exhaust gas is maintaned to a predetermined constant value. The constant EGR ratio helps to generate an unstable combustion during when a low engine load condition occurs in the combustion chambers, for example, surging, due to the effect of the exhaust gas remaining in the combustion chambers without being exhausted to the exhaust system of the engine. It is well know to control, in accordance with the engine load, the amount of the exhaust gas introduced into the back pressure control mechanism from the exhaust system of the engine, in order to prevent the occurrence of surging while maintaining a large $NO_x$ emission-decreasing effect by means of the EGR system.

A prior art exhaust gas recirculation system of a back pressure control type incorporated with an air injection system for eliminating HC and CO emissions can, for controlling the amount of recirculated exhaust gas in accordance with the engine load, be provided with an air by-pass mechanism for diverting air from the air injection system to the exhaust gas recirculation system and for controlling the amount of diverted air in accordance with the engine load.

SUMMARY OF THE INVENTION

An object of the present invention is to provide a novel construction of an exhaust gas cleaning apparatus provided with a by-pass mechanism for diverting a part of the air in a secondary air introduction system into an exhaust gas recirculation system.

Another object of the present invention is to provide an exhaust gas cleaning apparatus for effectively controlling the air-fuel ratio as well as the amount of recirculated exhaust gas for maintaining a stable combustion, a good suppression of $NO_x$ emissions and a high fuel-consumption efficiency.

According to the present invention, an apparatus for cleaning exhaust gas of an internal combustion engine is provided, which apparatus comprises: exhaust gas recirculation passageway means adopted for connecting an exhaust system of the engine with an intake system of the engine for introducing a part of the exhaust gas in the exhaust system into the intake system; first value means for controlling the pressure of recirculated exhaust gas in the exhaust gas recirculation passageway means so that the pressure is maintained at a predetermined value which is close to the atmospheric air pressure value; air pump means for generating a flow of air; secondary air introduction passageway means connecting the air pump means with the exhaust system for introducing secondary air into the exhaust system; by-pass passageway means connecting the secondary air introduction passageway means with the exhaust gas recirculation passageway means for diverting a part of the secondary air in the secondary air introduction passageway means into the exhaust gas recirculation passageway means; second valve means for controlling the amount of the diverted air; and vacuum control means for controlling the opening of the second valve means in accordance with the opening of a throttle valve and for controlling the opening of the second valve means so that a large amount of diverted air is passed through the second value means for a predetermined period after the throttle valve is opened from the closed position.

BRIEF DESCRIPTION OF THE ATTACHED DRAWINGS

DESCRIPTION OF A PREFERRED EMBODIMENT

Figure 1:
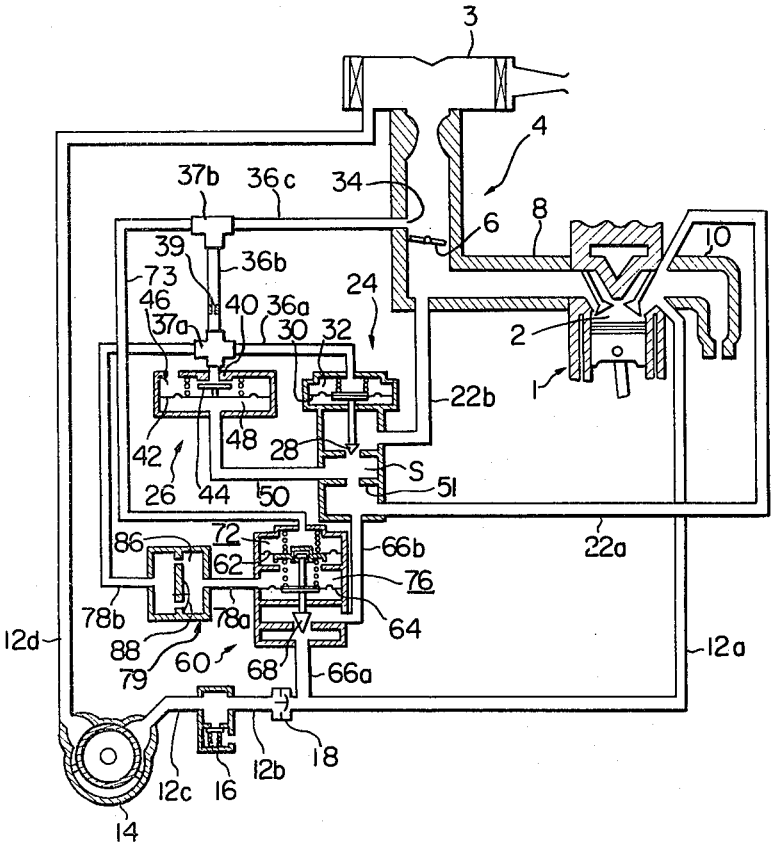
FIG. 1 is a schematic view of an exhaust gas cleaning apparatus according to the present invention.

In FIG. 1 showing a schematic view of an embodiment of the present invention, reference numeral 1 designates the body of an internal combustion engine. Air from an air cleaner 3 of the engine is mixed with fuel by means of a carburetor 4 to produce an air-fuel mixture. The air-fuel mixture, the amount of which is controlled in accordance with the opening of a throttle valve 6 of the carburetor 4, is introduced, via an intake manifold 8, to combustion chambers 2 formed in the engine body 1. Exhaust gas resulting from combustion in the chambers is discharged to an exhaust manifold 10.

A secondary air introduction system comprises air pipes 12*a*, 12*b*, 12*c* and 12*d*, in which passageways for secondary air are formed. An air pump 14 operated by a not-shown crankshaft of the engine is connected to the air cleaner 3 via the pipe 12*d* for sucking the purified air from the air cleaner 3. The air from the air pump 14 is introduced into the exhaust manifold 10 via the pipe 12*c*, a pressure relief valve 16, the pipe 12*b*, a check valve 18 and the pipe 12*a*. The thus-introduced secondary air serves to oxidize unburnt components remaining in the exhaust gas as is well known to those skilled in this art.

An exhaust gas recirculation system comprises pipes 22*a* and 22*b*, in which exhaust gas recerculation passageways are formed. The pressure of the exhaut gas recirculated from the exhaust manifold 10 to the intake manifold 8 by way of the EGR pipes 22*a* and 22*b* is controlled by a so-called back pressure control mechanism which comprises an exhaust gas flow control valve 24 and a modulator valve 26. The exhaust gas flow control valve 24 has a valve member 28 to control the amount of recirculated exahsut gas directed from the EGR pipe 22*a* to the EGR pipe 22*b*. The valve member 28 is connected to a diaphragm 30 which is springurged so that the valve member 28 can disconnect the EGR pipe 22*b* from the EGR pipe 22*a*. The diaphragm 30 forms, on one side thereof remote from the valve member 28, a vacuum chamber 32 which is connected, via a vacuum signal pipe 36*a*, a connection unit 37*a*, a vacuum signal pipe 36*b*, another connection unit 37*b* and a vacuum signal pipe 36*c*, to a vacuum signal port (or source) 34 formed in the carburetor 4 at a position located above the throttle valve 6 which is in its idle position. An orifice 39 is formed in the pipe 36*b* for controlling the speed of introducing a vacuum signal to the back pressure control system.

The modulator valve 26 has a valve member 44 which faces a valve seat 40 opened to the connection unit 37*a* for communicating with the vacuum chamber 32 of the exhaust gas flow control valve 24. The diaphragm 42 which is spring-urged so that the valve member 44 is detached from the valve seat 40 forms on one side thereof, near the valve member 40, a chamber 46 opened to the atmosphere. The diaphragm 42 forms on the other side thereof, remote from the valve seat 40, another chamber 48 which is connected, via an exhaust gas pressure conduit 50, to a so-called constant pressure space S formed between the valve member 28 and a slit (or orifice) member 51.

As is well known to those skilled in this art, the modulator valve 26 operates, in response to the pressure of the exhaust gas in the pressure control chamber S of the exhasut gas flow control valve 24, to selectively open the vacuum chamber 32 of the exhaust gas flow control valve 24 to the atmosphere, so that the pressure of the chamber S is maintained at a predetermined pressure near the atmospheric air pressure. The constant pressure of the exhaust gas in the chamber S allows an ideal EGR operation to be carried out as is well known to those skilled in this art.

In order to maintain a stable combustion in the combustion chamber, it is necessary to maintain the ratio of the amount of exhaust gas to the amount of intake combustible gas to maintain the ratio within a predetermined range. When the engine is under a low load condition wherein the total amount of gas in the combustion chambers 2 is small, the effect of the exhaust gas remaining in the combustion chambers 2 is not negligible. Therefore, it is necessary to control the amount of recirculated exhaust gas introduced into the combustion chamber 2 so that the amount of the recirculated gas is increased as the engine load increases.

Figure 2:
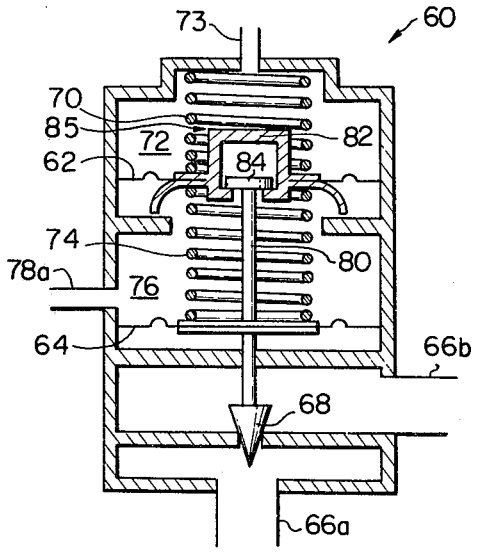
FIG. 2 is an enlarged cross-sectional view indicating the air-flow control valve shown in FIG. 1.

A valve mechanism is incorporated into the engine provided with the back pressure control type EGR system and with the secondary air introduction system, for effectively controlling the amount of the recirculated exhaust gas in accordance with the engine load. The valve mechanism includes an air-flow control valve 60 adapted for controlling, in accordance with the engine load, the amount of air diverted from the secondary air passageway to the exhaust gas recirculation passageway. As shown in FIG. 2, which is an enlarged partial view of FIG. 1, the air-flow control valve 60 is provided with two diaphragms 62 and 64, for effecting a two-stage control of the opening of a valve member 68 which is located between a by-pass air pipe 66*a* connected to the secondary air pipe 12*a* (FIG. 1) and another by-pass air pipe 66*b* connected to the exhaust gas flow control valve 24 (FIG. 1). The first diaphragm 62, which is downwardly urged by a spring 70, forms, on one side thereof, a first vacuum signal chamber 72. This chamber 72 is opened to the vacuum source 34 (FIG. 1) by way of a vacuum signal pipe 73 connected to the pipe 36*c* (FIG. 1). Another vacuum signal chamber 76 is formed between the first diaphragm 62 and the second diaphragm 64, in which chamber a spring 74 is arranged to urge and separate the diaphragm 62 and 64 from each other. The second vacuum signal chamber 76 is opened to the vacuum source 34 by a vacuum conduit 78, a vacuum delay unit 79 (in FIG. 1) and a vacuum conduit 78*b*, which is connected to the connection unit 37*a* (FIG. 1). As shown clearly by FIG. 2, the valve member 68 is rigidly connected to the second diaphragm 64 by a valve rod 80. However, the first diaphragm 62 is connected to the valve member 68 by means of a one-way clutch mechanism, which is itself known and comprised of a stopper member 82 for defining a channel of a substantially U-shaped cross-section, and by means by a plate member 84 secured to the upper end of the rod 80 and arranged in the channel of the stopper member 82. This one-way clutch mechanism serves to effect the two-stage control of the amount of air diverted from the secondary air introduction system to the exhaust gas recirculation system, which will be fully described later.

The vacuum delay unit 79 has, as shown in FIG. 1, an orifice 86 of a predetermined inner diameter and a check valve 86. The vacuum delay unit 79 serves to effect the two-stage control in accordance with the operating condition of the engine.

The operation of the above-mentioned system according to the present invention will now be described.

When the throttle valve 6 is opened from the idle position for starting the engine so that the throttle valve 6 is located upstream of the vacuum signal port 34, a vacuum signal is transmitted from the port 34 to the vacuum chamber 32 of the exhaust gas flow control valve 24, via the vacuum tube (or signal pipe) 36*c*, the connection unit 37*b*, the vacuum tube (or signal pipe) 36*b*, the connection unit 37*a* and the vacuum signal pipe 36*a*. The modulator valve 26 operates, in accordance with the pressure of the recirculated exhaust gas, in the space S of the EGR valve 24, to selectively connect the vacuum chamber 32 of the EGR valve 24 with the chamber 46 of the modulator valve 26 opened to the atmosphere. Thus, the vacuum level in the vacuum chamber 32, i.e. the degree of opening of the valve member 28 is controlled so that the pressure in the space S is maintained to a predetermined pressure close to the atmospheric air pressure. The vacuum signal at the vacuum signal port 34 is also transmitted to the first vacuum signal chamber 72 of the air-flow control valve 60, via the vacuum signal pipe 36*c*, the connection unit 37*b*, and the vacuum signal pipe 73, and transmitted to the second vacuum signal chamber 76, via the vacuum signal pipe (or tube) 36*c*, the connection unit 37*b*, the vacuum signal pipe 36*b*, the connection unit 37*a*, the pipe (or conduit) 78*b*, the vacuum delay unit 79 and the pipe 78*a*. Since no flow restriction orifice is provided in the vacuum line connecting the port 43 and the first vacuum signal chamber 72, the vacuum level in the first vacuum signal chamber 72 instantly reaches a high enough level to allow the diaphragm 62 to be upwardly displaced against the force of the spring 70 just after the throttle valve 6 is opened from the idle position, so that the valve 6 is located above the vacuum source 34. The upward movement of the diaphragm 62 is transmitted, via the one-way clutch mechanism 85 (FIG. 2) which is comprised of the stopper member 82 and the plate member 84, to the valve rod 80 which is connected to the valve member 68, thus causing the valve member 68 to open. Since the orifice 86 is provided in the vacuum line connecting the vacuum port 34 with the second chamber of the air-flow control valve 60, the vacuum level in the second vacuum signal chamber 76 is sufficiently low enough, when the throttle valve begins to open from the idle position, to cause the spring 74 to move the diaphragm 64 downwardly against the vacuum force generated in the diaphragm 64. As a result of this, the opening of the valve member 68, i.e., the amount of the air diverted into the air pipe **66*b* located downstream of the valve member 68 from the by-pass pipe 66*a* located upstream of the valve member 68 is controlled in accordance with the vacuum level in the first vacuum signal chamber 72. The vacuum level at the vacuum signal port 34 connected to the first vacuum signal chamber 72 is inversely proportional to the opening of the throttle valve 6 which corresponds to the engine load (as is well known to those skilled in this art). Therefore, as the engine load increases, the opening of the valve member 68 of the air-flow control valve 60 becomes small enough for decreasing the amount of diverted air added to the recirculated exhaust gas passed through the exhaust gas flow control valve 24 directed toward the intake manifold 8. Thus, the EGR ratio (the ratio of the amount of recirculated exhaust gas introduced into the intake manifold 8 from the EGR pipe 22*b* to the total amount of air introduced into the combustion chambers 2) is controlled so that the EGR ratio increases in accordance with the increase of the engine load. By such type of control of the EGR ratio, a stable combustion in the combustion chambers 2** and a low toxic component emission can both be maintained.

When a predetermined time, which is determined by the inner diameter of the orifice 86, elapses after the throttle valve 6 has moved from its idle position (in other words, when the engine is operating under a steady condition), the vacuum level in the second vacuum signal chamber 76 of the air-flow control valve 60 becomes high enough to cause the diaphragm 64 to be moved upwardly against the force of the spring 74. The valve rod 80 connected to the diaphragm 64 can be utilized to cause a limited amount of upward movement, which amount of upward movement corresponds to the distance between the inner surface of the U-shaped channel in the stopper member 82 and the plate member 84. Thus, the opening of the valve member 68 is additionally enlarged for increasing the amount of air diverted into the EGR valve. Thereofore, a low EGR ratio is obtained during the steady condition of the engine, so that surging does not take place while a small toxic component emission is being maintained.

While the present invention is described with reference to the drawings indicating one embodiment of the invention, many modifications and changes can be made by those skilled in this art without departing from the scope of the invention.

What is claimed is:

1. An apparatus for cleaning exhaust gas of an internal combustion engine, comprising:

exhaust gas recirculation passageway means adapted for connecting an exhaust system of the engine with an intake system of the engine for introducing a part of the exhaust gas in the exhaust system into the intake system;

first valve means for controlling pressure of recirculated exhaust gas in said exhaust gas recirculation passageway means so that said pressure is maintained at a predetermined pressure which is close to the atmospheric air pressure;

air pump means for generating a flow of air;

secondary air introduction passageway means connecting said air pump means with said exhaust system for introducing secondary air into said exhaust system;

by-pass passageway means connecting said secondary air introduction passageway means with said exhaust gas recirculation passageway means for diverting a part of said secondary air in said secondary air introduction passageway means into said exhaust gas recirculation passageway means;

second valve means for controlling the amount of said diverted air; and vacuum control means for controlling the opening of said second valve means in accordance with opening of a throttle valve and for controlling the opening of said second valve means so that a large amount of diverted air is passed through said second valve means for a predetermined period after said throttle valve is opened from a closed position.

2. An apparatus according to claim 1, wherein said vacuum control means comprises a pair of parallelly-arranged first and second diaphragms; a first chamber formed on one side of said first diaphragm remote from said second diaphragm; a second vacuum chamber formed between said first and second diaphragms, said first chamber being adapted for connecting to a vacuum source formed in said intake system of the engine at a position slightly above said throttle valve in idle position; vacuum delay means located between said second chamber and said vacuum source, said second diaphragm being fixedly secured to said second valve means, and one-way clutch means connecting said first diaphragm with said second valve means for permitting displacement of said first diaphragm to occur in accordance with the vacuum level in said first chamber and for permitting a limited amount of displacement of said second diaphragm to occur in accordance with said vacuum level in said second chamber.

* * * * *